US007185996B1

(12) United States Patent
Caprio

(10) Patent No.: US 7,185,996 B1
(45) Date of Patent: Mar. 6, 2007

(54) SHAKE LIGHTING DICE KEY HOLDER

(76) Inventor: Susan Caprio, 965 Orchid La., Gulfstream, FL (US) 33483

( * ) Notice: Subject to any disclaimer, the term of this patent is extended or adjusted under 35 U.S.C. 154(b) by 0 days.

(21) Appl. No.: 11/004,745

(22) Filed: Dec. 6, 2004

Related U.S. Application Data

(63) Continuation-in-part of application No. 10/657,295, filed on Sep. 8, 2003, now abandoned.

(51) Int. Cl.
*F21V 33/00* (2006.01)

(52) U.S. Cl. ..... 362/100; 362/109; 362/116; 362/276; 362/253; 463/22; 463/3 L

(58) Field of Classification Search ..... 362/253, 362/100, 109, 116, 276, 802; 463/22, 31; 273/146
See application file for complete search history.

(56) References Cited

U.S. PATENT DOCUMENTS 1,363,567 A * 12/1920 Cobb ..... 63/23
4,124,881 A * 11/1978 Haber et al. ..... 362/253
4,184,304 A * 1/1980 Merchant ..... 52/746.1
4,480,294 A * 10/1984 Carboni ..... 362/184
4,516,776 A * 5/1985 Nicholas ..... 273/146
4,641,840 A * 2/1987 Larson ..... 463/22
4,858,931 A * 8/1989 McKechnie ..... 463/22
5,400,232 A 3/1995 Wong
5,465,197 A 11/1995 Chien
6,601,967 B1 8/2003 Zeller

* cited by examiner

*Primary Examiner*—Thomas M. Sember
(74) *Attorney, Agent, or Firm*—Alvin S. Blum

(57) ABSTRACT

A key holder apparatus is provided with a battery powered light source. When shaken, a flashing light is emitted for a preset time interval. This enables a user to readily find her keys when they are within a cluttered purse. The light source is in a housing in the form of a dice with six transparent sides to enhance the chances of light being seen in a crowded purse. The light source is preferably one or more light emitting diodes for low power and compactness considerations. A vibration switch in the circuit is not actuated by minor movement such as caused by usual purse motion to the device or when swinging in an automobile ignition.

8 Claims, 3 Drawing Sheets

SHAKE LIGHTING DICE KEY HOLDER

This application is a continuation in part of utility patent application Ser. No. 10/657,295 filed Sep. 8, 2003, now abandoned, incorporated herein by reference.

This invention relates to battery-powered lights and more particularly to a key holder provided with a light source in the form of a dice that is activated for a brief time interval after being shaken.

BACKGROUND OF THE INVENTION

When a person is searching for keys that are in a container with many other items, it may be awkward and time consuming to find them. This is especially common when the keys are in a crowded purse, and the person needs to find the keys in a hurry.

U.S. Pat. No. 6,601,967 issued Aug. 5, 2003 to Zeller discloses a battery-powered flashlight with key holder. The light is actuated when the user rotates a knob. This is only useful after the user has found the key holder.

U.S. Pat. No. 5,400,232 issued Mar. 21, 1995 to Wong, and U.S. Pat. No. 5,465,197 issued Nov. 7, 1995 to Chien disclose vibration flashlights with a spring that at times closes a battery and light emitting diode circuit when vibrated. They are directed to attachment to clothing, shoes, etc. to make the wearer visible while active.

There are dice in the prior art that emit flashing light only when struck vigorously such as by throwing against a surface.

It would be useful to provide a key holder with a self-contained battery that would light up in a cluttered purse only when the purse were shaken.

SUMMARY OF THE INVENTION

It is accordingly an object of the invention to provide a key holder that will light up when shaken and remain lit for a brief preset time interval thereafter such as five to fifteen seconds to thereby enable the user to find the keys among all the items in a purse. The user has only to shake the purse. The sensitivity of the device may be set so that the ordinary motion of the purse while in use will not activate the light circuit. If the light were triggered by less vigorous shaking, it would exhaust the battery too quickly. This will prolong the life of the batteries. Use of a light emitting diode will further prolong battery life. The device may also be of use, after the keys are located, to find a keyhole in the dark. The device of the invention comprises a circuit including a battery and a light source in series with a vibration switch. When the vibration switch is shaken hard enough, the circuit is completed. This connects the battery intermittently to the one or more light sources such as, but not limited to, light emitting diodes. The periodic light emissions continue for a preset time, such as five to thirty seconds, after actuation and then the circuit opens.

People are used to shaking dice and praying for good luck while gambling. It will enhance the marketability of the device of the invention, as well as suggesting that it be shaken to grant good luck in finding your keys in your purse if the light assembly of the invention takes the form of a gambling dice. The light element of the invention is in the form of a single dice with transparent walls, so that the light is emitted from all six faces. This enhances the retrieval function in that light is more likely to be visible even when the device is buried in the many items that may be present in the purse.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
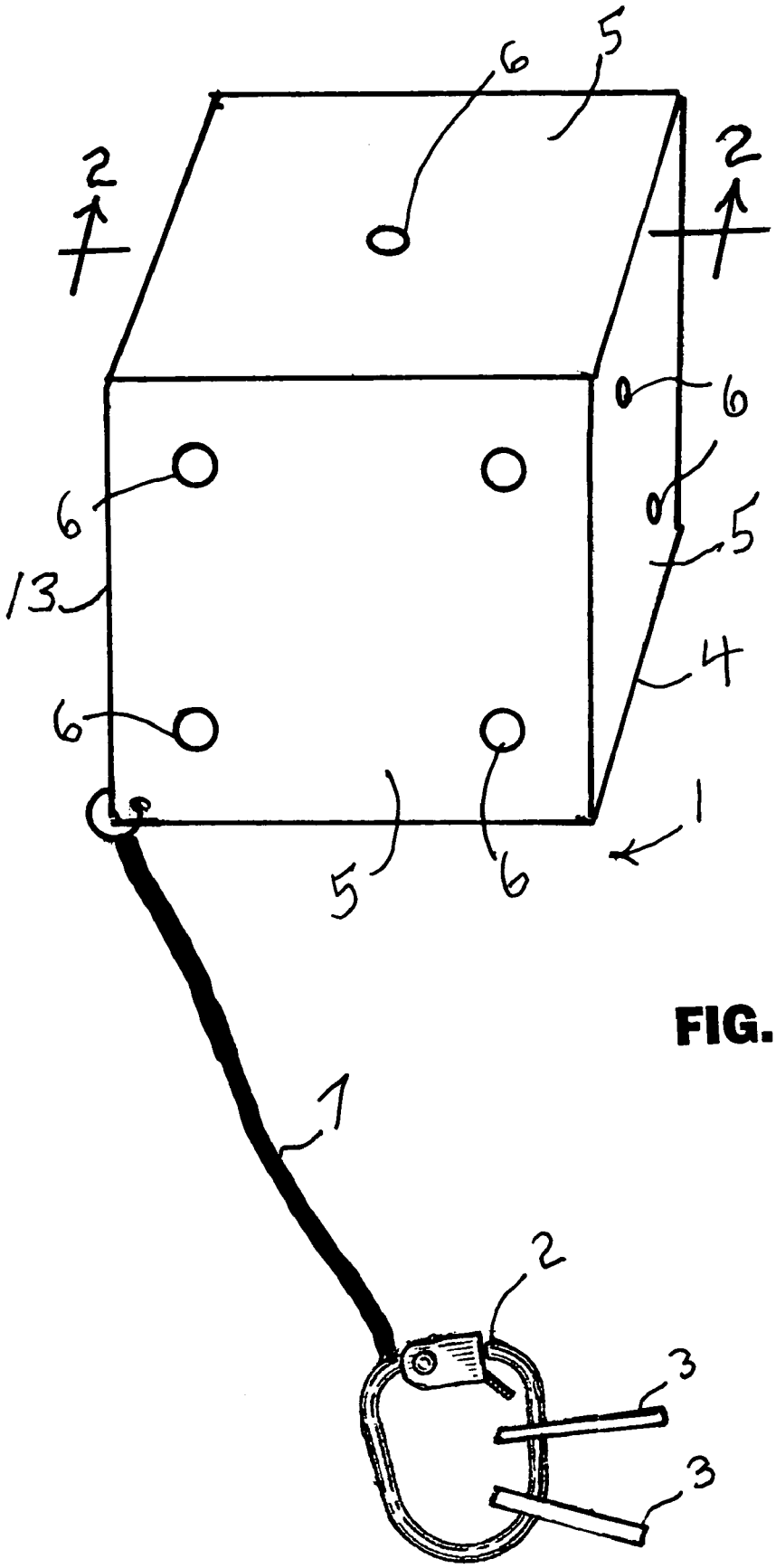
FIG. 1 is a perspective view of the key holding apparatus of the invention.
Figure 2:
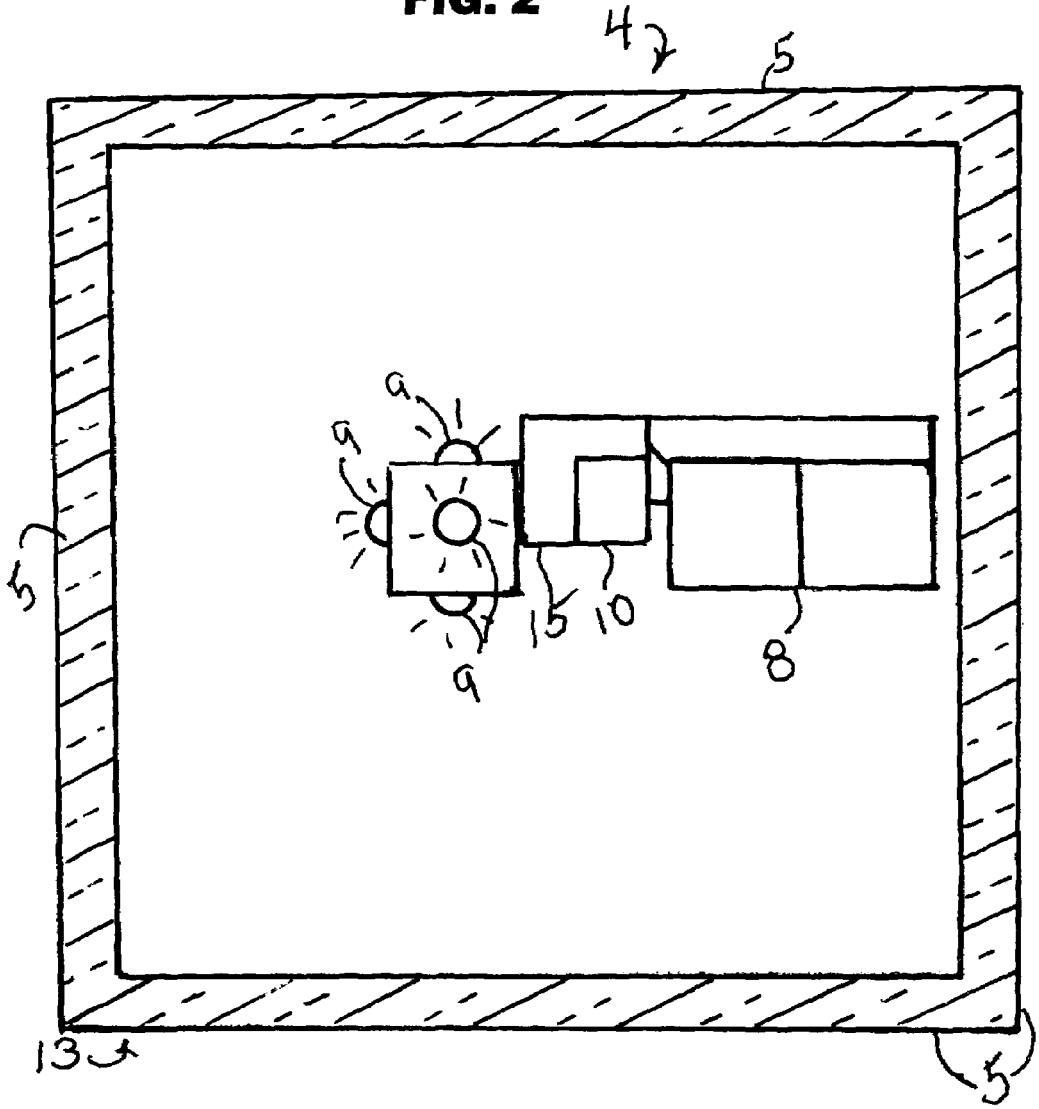
FIG. 2 is a sectional view taken through line 2—2 of FIG. 1.
Figure 3:
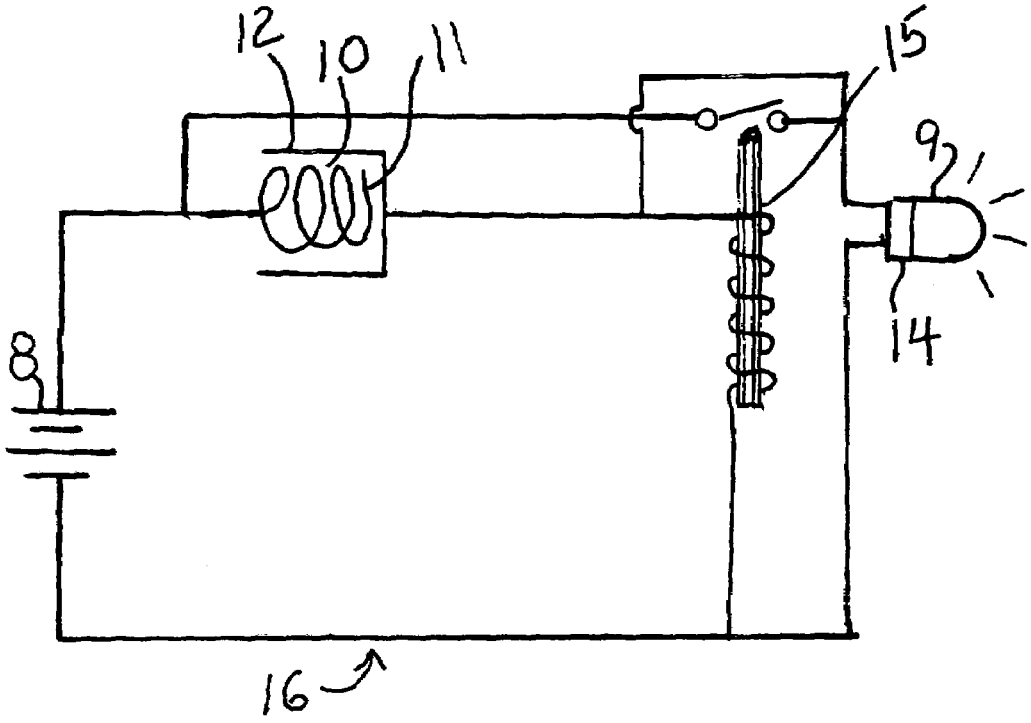
FIG. 3 is a schematic view of an electronic circuit of the invention.

Referring now to the drawing FIGS. 1–3, the invention comprises a key holding apparatus 1 with a key holding assembly 2 for holding one or more keys 3. The key holding assembly 2 is connected to an illumination means 13 by a connecting element 7. The illumination means 13 is in the form of a gambling dice with a housing 4 having six transparent sides 5 with the dots 6 as found on dice. Within the housing 4 is one or more lights 9. The one or more lights are preferably, but not limited to, light emitting diodes. A battery power source 8 is connected to the light source 9 through a circuit that includes a vibration switch 10 in series.

The vibration switch may take many forms well known in the art. As shown in the embodiment of FIG. 3, the switch comprises a conductive spring 11 having a captive proximal end. The distal free end makes electrical contact with conductive cylinder 12 to complete the circuit only when shaken with a certain preset intensity. That intensity is greater than that usually encountered in normal purse use. It is also greater than that to which the apparatus is exposed when hanging from an automobile ignition. A holding relay 15 is energized when the momentary contact is made by spring 11 striking conductive cylinder 12. This maintains the closure of the circuit after the spring contact is removed for a preset time interval before opening. During this time the light, or lights, are emitting light that is shining through all six sides of the housing. After this time interval, the light(s) goes out. The time interval is selected to be long enough to enable the user to find the lighted key holder in a cluttered purse. This may be as short as five to fifteen seconds. The flashing circuit 14 causes the lights to only emit light periodically to further reduce the battery drain. The short time interval and low power demands of a light emitting diode enable a small battery to supply the power needs for a long time. The batteries may be non-replaceable or replaceable, as desired. The schematic diagram is illustrative. It is by no means limiting, as the circuit may be more effectively produced in compact and economical form by semiconductor techniques.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A key holding apparatus with means for enhanced locating of a person's keys comprising:

a) key holding assembly for holding at least one key;

b) a housing in the form of a gambling dice with six transparent sides connected to the key holding means;

c) a battery holder within the housing with first and second battery connections;

d) a light source within the housing arranged to shine light in a flashing mode out of the six sides of the housing;

e) a vibration switch within the housing;

f) switch means within the housing operatively connected between the battery connections and the vibration switch for causing shaking of the key holder to a preset intensity to actuate the switch means and cause it to remain closed for a preset time interval after actuation when a battery is in the housing; and g) means for connecting the battery connections to the light source during the time interval, to thereby emit light from the housing through the six sides for a preset time interval after the user has shaken the key holder.

2. The apparatus according to claim 1 in which the preset intensity is greater than that resulting from usual purse operation.

3. The apparatus according to claim 2 in which the preset time interval is no greater than thirty seconds.

4. The apparatus according to claim 1 in which the preset time interval is no greater than thirty seconds.

5. A key holding apparatus with means for enhanced locating of a person's keys comprising:

a) key holding assembly for holding at least one key;

b) an illumination means connected to the key holding means, the illumination means including;

1) a battery;

2) a light source;

3) a vibration switch; and 4) circuitry operatively interconnecting the battery, the light source, and the vibration switch such that shaking the key holder with a preset intensity will actuate the light source in a flashing mode for a preset time interval long enough to enable the person to find the key holder in a cluttered purse; and the illumination means contained within a housing having six transparent sides through which light is emitted from the light source, the housing emulating a dice.

6. The apparatus according to claim 5 in which the preset intensity is greater than that resulting from usual purse operation.

7. The apparatus according to claim 6 in which the preset time interval is no greater than thirty seconds.

8. The apparatus according to claim 5 in which the preset time interval is no greater than thirty seconds.

* * * * *